United States Patent [19]

Giroux et al.

[11] Patent Number: 5,038,862

[45] Date of Patent: Aug. 13, 1991

[54] EXTERNAL SLEEVE CEMENTING TOOL

[75] Inventors: Richard L. Giroux; John T. Brandell, both of Duncan, Okla.

[73] Assignee: Halliburton Company, Duncan, Okla.

[21] Appl. No.: 515,883

[22] Filed: Apr. 25, 1990

[51] Int. Cl.[5] ..... E21B 34/14

[52] U.S. Cl. ..... 166/289; 166/154; 166/332

[58] Field of Search ..... 166/386, 289, 154, 155, 166/332, 166

[56] References Cited

U.S. PATENT DOCUMENTS

| | | | |
|---|---|---|---|
| 2,380,022 | 7/1945 | Burt | 166/1 |
| 2,435,016 | 1/1948 | Pitts | 166/1 |
| 2,667,926 | 2/1954 | Alexander | 166/1 |
| 2,723,677 | 11/1955 | Middleton et al. | 137/270 |
| 2,804,830 | 9/1957 | Garrett | 103/233 |
| 2,924,278 | 2/1960 | Garrett et al. | 166/214 |
| 2,998,075 | 8/1961 | Clark, Jr. | 166/154 |
| 3,051,243 | 8/1962 | Grimmer et al. | 166/224 |
| 3,071,193 | 1/1963 | Raulins | 166/226 |
| 3,151,681 | 10/1964 | Cochran | 166/224 |
| 3,223,160 | 12/1965 | Baker | 166/27 |
| 3,228,473 | 1/1966 | Baker | 166/154 |
| 3,247,905 | 4/1966 | Baker | 166/194 |
| 3,355,142 | 11/1967 | Kammerer, Jr. et al. | 251/175 |
| 3,524,503 | 8/1970 | Baker | 166/289 |
| 3,768,556 | 10/1973 | Baker | 166/154 |
| 3,768,562 | 10/1973 | Baker | 166/289 |
| 3,789,926 | 2/1974 | Henley et al. | 166/224 R |
| 3,811,500 | 5/1974 | Morrisett et al. | 166/154 |
| 3,948,322 | 4/1976 | Baker | 166/289 |
| 4,246,968 | 1/1981 | Jessup et al. | 166/334 |
| 4,269,278 | 5/1981 | Vann | 175/4.51 |
| 4,421,165 | 12/1983 | Szarka | 166/151 |
| 4,457,368 | 7/1984 | Knierimen et al. | 166/217 |
| 4,512,406 | 4/1985 | Vann et al. | 166/297 |
| 4,520,870 | 6/1985 | Pringle | 166/317 |
| 4,848,457 | 7/1989 | Lilley | 166/332 |
| 4,858,687 | 8/1989 | Watson et al. | 166/153 |

OTHER PUBLICATIONS

Exhibit A—HOS Cementer (Date—More than one year prior to filling).

Exhibit B—Drawing of Multi-State Packer Cementing Collar (Date—More than one year prior to filling).

Exhibit C—1982-1983, Product Service Catalog of Bakerline Division of Baker Oil Tools, Inc., p. 4.

Exhibit D—Baker Eastern Division 1978-1979 Catalog, of Baker Oil Tools, Inc., p. 549.

*Primary Examiner*—Terry L. Melius

*Attorney, Agent, or Firm*—James R. Duzan; L. Wayne Beavers

[57] ABSTRACT

A cementing tool includes a tubular housing having an inner passage defined longitudinally therethrough and having a radially outer surface. The housing also has a cementing port and a longitudinal slot both disposed through a wall thereof. An outer closure sleeve is slidably received about the outer surface of the housing and is movable relative to the housing between an open position wherein the cementing port is uncovered by the closure sleeve and a closed position wherein the cementing port is closed by the closure sleeve. An inner operating sleeve is slidably received in the housing and slidable between first and second positions relative to the housing. A pin extends radially through the slot and fixedly connects the operating sleeve and the closure sleeve together for common longitudinal movement relative to the housing. When cementing is completed, a cementing plug engages the operating sleeve and causes it to move the external closure sleeve downward thus closing the cementing port. Internal components of the cementing tool may then be drilled out of the housing thus leaving a smooth bore through the cementing tool through which other equipment can be run.

18 Claims, 5 Drawing Sheets

EXTERNAL SLEEVE CEMENTING TOOL

BACKGROUND OF THE INVENTION

1. Field Of The Invention

The present invention relates generally to casing valves for use in the casing of a well, and more particularly, but not by way of limitation, to sliding sleeve cementing tools constructed for placement in a well casing.

2. Description Of The Prior Art

In the drilling of deep wells, it is often desirable to cement the casing in the well bore in separate stages, beginning at the bottom of the well and working upward.

This process is achieved by placing cementing tools, which are primarily valved ports, in the casing or between joints of casing at one or more locations in the well bore, flowing cement through the bottom of the casing, up the annulus to the lowest cementing tool, closing off the bottom, opening the cementing tool, and then flowing cement through the cementing tool up the annulus to the next upper stage and repeating this process until all stages of the well are cemented.

Cementing tools used for multi-stage cementing usually have two internal sleeves, both of which are usually shear-pinned initially in an upper position, closing the cementing ports in the tool. To open the cementing ports a plug is flowed down the casing and seated on the lower sleeve. Fluid pressure is then increased in the casing until sufficient force is developed on the plug and sleeve to shear the shear pins and move the lower sleeve to the position uncovering the cementing ports. Cement is then flowed down the casing and out the ports into the annulus. When the predetermined desired amount of cement has been flowed into the annulus another plug is placed in the casing behind the cement and flowed down the casing to seat on the upper sleeve. The pressure is increased on the second plug until the shear pins holding it are severed and the upper sleeve is moved down to close the cementing ports.

One cementing tool of the type just described is disclosed in U.S. Pat. No. 3,768,556 to Baker, assigned to the assignee of the present invention.

One improvement upon the Baker '556 device is found in U.S. Pat. No. 4,246,968 to Jessup et al., and also assigned to the assignee of the present invention. The '968 patent discloses a device similar to that of the Baker '556 patent, except it has added a protective sleeve which covers some of the internal areas of the tool which are otherwise exposed when the internal sleeves move downward to close the port. This protective sleeve prevents other tools which may later be run through the cementing tool, from hanging up on the inner bore of the cementing tool.

Another approach which has been utilized for cementing tools is to locate the closure sleeve outside the housing of the tool. A line of tools distributed by the Bakerline Division of Baker Oil Tools, Inc., known as the Bakerline Model "J" and Model "G" stage cementing collars have closure sleeves located outside the housing of the tool. These closure sleeves have a differential area defined thereon and are hydraulically actuated in response to internal casing pressure which is communicated with the sleeves by movement of an internal operating sleeve to uncover a fluid pressure communication port. The Bakerline devices are disclosed in the 1982–1983 Product Service Catalog of the Bakerline Division of Baker Oil Tools, Inc., which catalog is entitled "Stage and Stab-In Cementing Equipment and Services BL-482", at page 4 thereof.

Also, the prior art includes non-rotating cementing plug sets as seen in U.S. Pat. No. 4,858,687 to Watson et al.

There is a need for a stage cementing tool which is relatively compact and simple of design, and yet provides reliable operation and a smooth, unobstructed bore after completion of the cementing job.

SUMMARY OF THE INVENTION

The present invention provides an improved cementing tool apparatus. The apparatus includes a tubular housing having an inner passage defined longitudinally therethrough and having a radially outer surface. The housing also has a cementing port and has a longitudinal slot both disposed through a wall thereof.

An outer closure sleeve is slidably received about the outer surface of the housing and is movable relative to the housing between an open position wherein the cementing port is uncovered by the closure sleeve and a closed position wherein the cementing port is closed by the closure sleeve.

An inner operating sleeve is slidably received in the inner passage of the housing and slidable between first and second positions relative to the housing.

A mechanical interlocking means extends through the slot and is operably associated with both the operating sleeve and the closure sleeve for mechanically transferring a closing force from the operating sleeve to the closure sleeve and thereby moving the closure sleeve to its closed position as the operating sleeve moves from its first position to its second position. The interlocking means preferably interlocks the operating sleeve and closure sleeve together for common longitudinal movement relative to said housing throughout the entire movement of said operating sleeve from its first position to its second position without any lost motion of the operating sleeve relative to the closure sleeve.

The closure sleeve itself is longitudinally hydraulically balanced and no unbalanced hydraulic force acts thereon at any time.

Additionally, a non-rotatable interlocking engagement is provided between the operating sleeve and a bottom cementing plug associated therewith, so that the cementing plug is prevented from rotating relative to the operating sleeve and the housing when the cementing plug and sleeve are later drilled out of the housing after the cementing job is completed.

This permits quick and easy drill-out of the internal components of the cementing tool after the cementing job is completed thus leaving a smooth, unobstructed bore through the tool which is substantially free of any obstruction which can hang up other tools which will subsequently be run therethrough.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
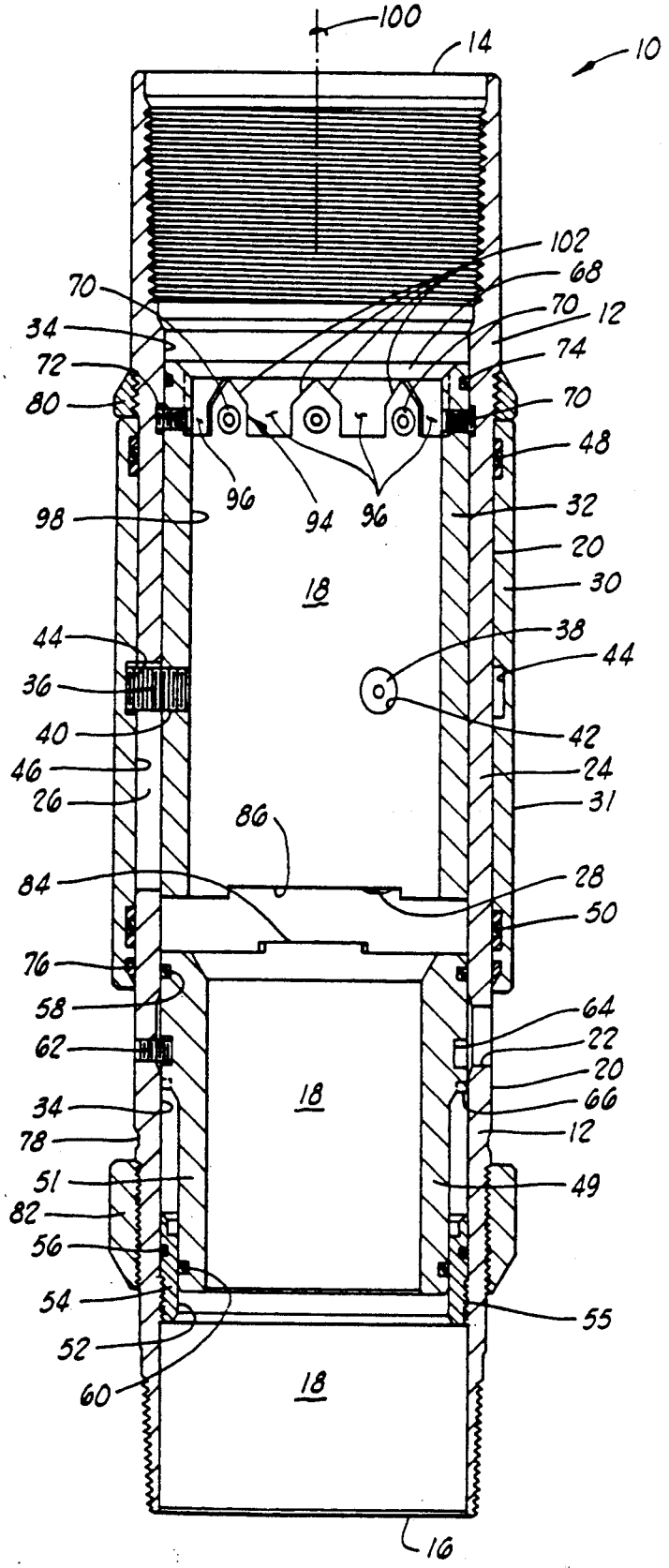
FIG. 1 is an elevation sectioned view of a preferred embodiment of the invention utilizing a hydraulically operated lower internal opening sleeve.

In FIG. 1, a cementing tool apparatus of the present invention is shown and generally designated by the numeral 10. The cementing tool 10 includes a tubular housing 12 having an upper end 14 and a lower end 16 with an inner passage 18 defined longitudinally therethrough from the upper end 14 to the lower end 16.

The tubular housing 12 has a radially outer surface 20. The housing 12 also includes a wall 24 having one or more cementing ports 22 disposed therethrough. The wall 24 also has three longitudinal slots disposed therethrough, two of which slots are shown in FIG. 1 and designated as 26 and 28.

The cementing tool 10 includes an outer, external closure sleeve 30 which is concentrically, closely, slidably received about the outer surface 20 of housing 12. The closure sleeve 30 is movable relative to the housing 12 between an open position as seen in FIG. 1, and a closed position wherein the cementing port 22 is closed by closure sleeve 30.

The closure sleeve 30 can be described as an external sleeve and has a generally cylindrical radially outer surface 31 which is exposed to the well annulus 124.

Figure 7:
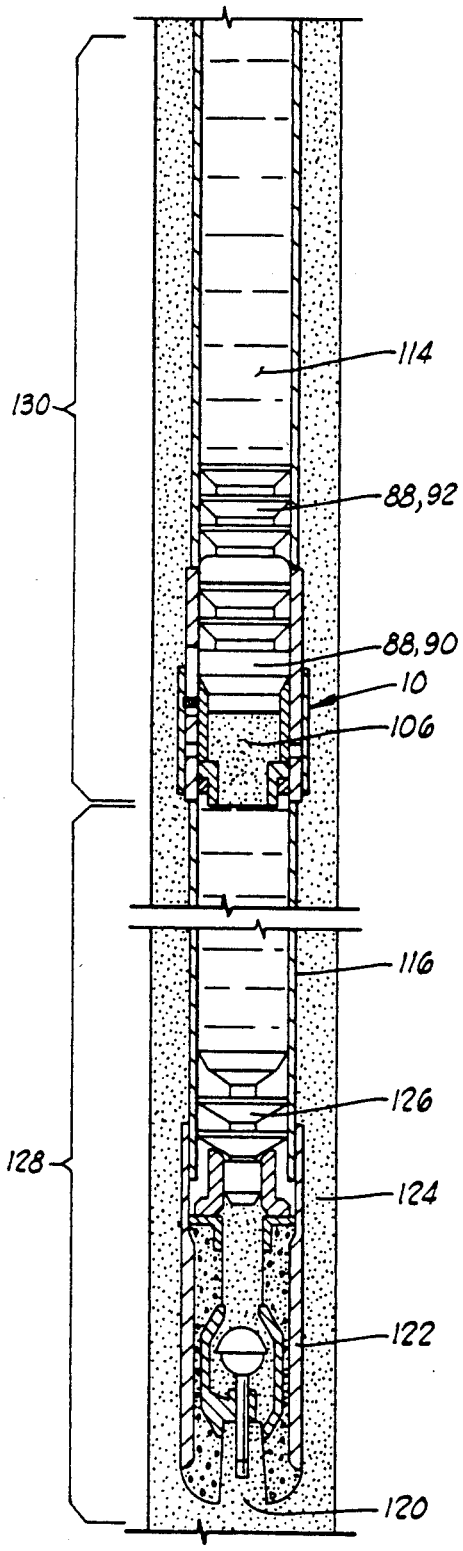

Cementing tool 10 includes an inner operating sleeve 32 which is slidably received in an inner bore 34 of housing 12. The operating sleeve 32 is slidable between a first position relative to housing 12 as seen in FIG. 1, and a second position corresponding to the closed position of closure sleeve 30 as schematically illustrated in FIG. 7.

Three pins, two of which are seen in FIG. 1 and designated as 36 and 38, extend through the slots 26 and 28, respectively, and are fixably connected to the operating sleeve 32 and closure sleeve 30 to interlock the operating sleeve 32 and closure sleeve 30 for common longitudinal movement relative to the housing 12 throughout the entire movement of the operating sleeve 32 from its first position to its second position. Since the pins 36 and 38 fixedly connect operating sleeve 32 to closure sleeve 30, there is no lost longitudinal motion of the operating sleeve 32 relative to the closure sleeve 30 as the operating sleeve 32 moves downward to close the cementing port 22 with the closure sleeve 30.

The pins 36 and 38 are threadedly engaged with threaded radial bores such as 40 and 42 extending through the operating sleeve 32 and tightly engage an internal annular groove 44 cut in the inner bore 46 of closure sleeve 30.

The pins such as 36 and 38 and their engagement with the operating sleeve 32 and 30 can all be referred to as a mechanical interlocking means extending through the slots such as 26 and 28 and operably associated with both the operating sleeve 32 and the closure sleeve 30 for transferring a closing force from the operating sleeve 32 to the closure sleeve 30 and thereby moving the closure sleeve 30 to its closed position as the operating sleeve 32 moves from its first position to its second position.

Pins 36 and 38 also serve to hold sleeve 32 so that it will not rotate as sleeve 32 is later drilled out of housing 12 after the cementing job is completed.

The cementing tool 10 includes an upper sliding seal 48 and a lower sliding seal 50 disposed in annular grooves cut in the bore 46 of closure sleeve 30 near its upper and lower ends. Each of the upper and lower sliding seals 48 and 50 include an O-ring held between two annular backup rings. When the closure sleeve 30 is in its open position as seen in FIG. 1, both the seals 48 and 50 are located above the cementing port 22. When the closure sleeve 30 is moved downward to its closed position, the lower seal 50 is located below cementing port 22 and the upper seal 48 is located above the cementing port 22 to effectively close the cementing port 22. Thus, the apparatus 10 can be said to have two and only two sliding seals between the closure sleeve 30 and the outer surface 20 of housing 12, one of said seals 48 being located above the cementing port 22 and the other seal 50 being located below the cementing port 22 when the closure sleeve 30 is in its said closed position.

Since both the upper seal 48 and lower seal 50 engage identical outside diameters of the outer surface 20 of housing 12, there is no unbalanced hydraulic pressure acting on the closure sleeve 30. Thus, the closure sleeve 30 can be described as being longitudinally hydraulically balanced.

As is apparent in FIG. 1, the inner passageway 18 of housing 12 is always in fluid pressure communication with the bore 46 of closure sleeve 30 between its upper and lower seals 48 and 50. In the position illustrated in FIG. 1, there is no seal between the lower end of operating sleeve 32 and the slots such as 26 and 28, thus fluid pressure within the passage 18 will reach the bore 46 of closure sleeve 30 between the seals 48 and 50, but due to the fact that closure sleeve 30 is hydraulically balanced, this pressure will not exert any unbalanced longitudinal force on the closure sleeve 30.

Figure 4:
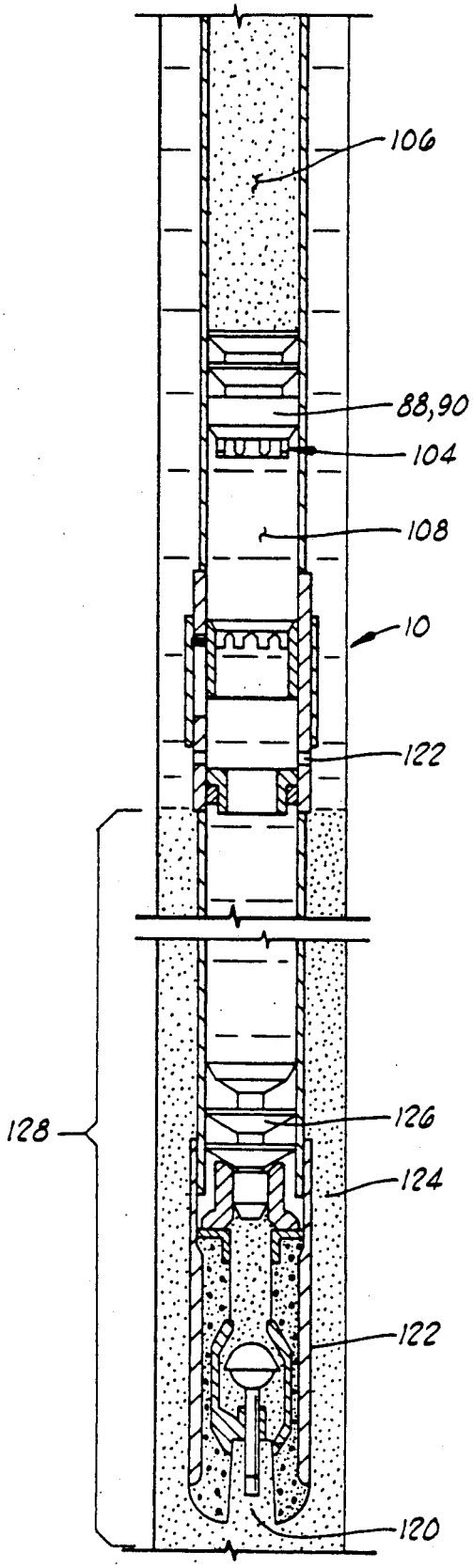

The cementing tool 10 further includes an internal lower opening sleeve 49 slidably received in the bore 34 of housing 12 below the operating sleeve 32. The opening sleeve 49 is slidable between a closed position as shown in FIG. 1 wherein the cementing port 22 is closed by the opening sleeve 49 and an open position, such as is schematically illustrated in FIG. 4 wherein the cementing port 22 is uncovered by the opening sleeve 49 as the opening sleeve 49 moves downward relative to housing 12. It is noted that when the opening sleeve 49 is in its closed position as seen in FIG. 1 and the operating sleeve 32 is simultaneously in its first position as shown in FIG. 1, the inner passage 18 of housing 12 is in fluid pressure communication with the bore 46 of closure sleeve 30 between its sliding seals 48 and 50.

The opening sleeve 49 in the embodiment of FIG. 1 is a hydraulically operated sleeve. It includes a reduced diameter lower portion 51 which is slidably received within a bore 52 of an anchor ring 54 which is fixedly attached to the inner bore 34 of housing 12 such as by thread 55. An O-ring seal 56 seals between anchor ring 54 and housing 12.

Opening sleeve 49 carries an upper annular sliding seal 58 which engages the bore 34 of housing 12, and carries a lower annular sliding seal 60 which engages the reduced diameter bore 52 of anchor ring 54, so that a differential area is defined between O-rings 58 and 60. Opening sleeve 49 is initially shear pinned in its closed position as shown in FIG. 1 by a plurality of shear pins 62 which are threaded through the wall of housing 12 and engage a groove 64 in opening sleeve 49.

As is further described below with regard to FIG. 4, the interior of the casing string in which the apparatus 10 is located can be closed off below the cementing tool 10 so that a high fluid pressure can be applied to the passage 18 through housing 12 which pressure will act downward on the differential area between O-rings 58 and 60 until the force exceeds that which can be held by the shear pins 62. Then the shear pins 62 will shear and the downward acting differential pressure will move the opening sleeve 49 downward until a lower shoulder 66 thereof engages the anchor ring 54. At that point, the upper O-ring 58 is located below cementing port 22 so that the cementing port 22 is open to the passage 18 through housing 12.

A non-rotating engagement is provided between the shoulder 66 of opening sleeve 49 and the upper end of anchor ring 54 by a lug and recess type interlocking structure (not shown) similar to lug 84 and recess 86 described below.

After the opening sleeve 49 has been moved down to its open position, cement can be pumped downward through the passage 18 and out the cementing port 22 in a manner further described below with reference to FIGS. 3–8.

After sufficient cement has been pumped out through cementing port 22, the closure sleeve 30 is closed by means of the operating sleeve 32. A closing force is applied to the operating sleeve 32 by a plug means which will seat on an annular seat 68 defined on the upper end of operating sleeve 32. The operating sleeve 32 is initially held in place relative to housing 12 by a plurality of shear pins 70 which are threaded through the operating sleeve 32 and received in a groove 72 in the bore 34 of housing 12. An upper sliding O-ring 74 seals between the operating sleeve 32 and the housing 12.

When the shear pins 70 are sheared due to a downward force acting on the operating sleeve 32, the operating sleeve 32 moves downward carrying the closure sleeve 30 with it. The closure sleeve 30 carries an inwardly biased locking ring 76 in a groove contained near its lower end. The locking ring 76 will snap into an outer annular groove 78 defined in the housing 12 to mechanically lock the closure sleeve 30 in its closed position relative to housing 12.

Upper and lower external support rings 80 and 82 are fixedly attached to the housing 12 at or near the positions of the upper and lower ends of the closure sleeve 30 when the closure sleeve is in its open position and closed position, respectively. The support rings 80 and 82 have outside diameters equal to or greater than the outside diameter of closure sleeve 30 so that if the tool 10 is placed against the wall of a casing, the rings 80 and 82 will hold the tool such that the closure sleeve 30 can still slide downward relative to housing 12 without binding against the casing.

The opening sleeve 49 has an upward extending lug 84 which will be received within a downward facing recess 86 in the lower end of operating sleeve 32 when the operating sleeve 32 moves downward to a position corresponding to the closed position of closure sleeve 30. This prevents the operating sleeve 30 from rotating relative to the opening sleeve 49 and housing 12 at a later time when the internal components are drilled out of the housing 12.

The cementing tool 10 of FIG. 1 is particularly designed for use with a cementing plug means 88 (see FIGS. 4–7) including a bottom plug 90 and a top plug 92. As is further described below, the cementing plug means 88 is used in connection with the second stage of cement which is pumped through the cementing port 22 of cementing tool 10.

The cementing tool 10 and its associated cementing plug means 88 are designed so that the cementing plug means 88 will not rotate relative to the housing 12 of cementing tool 10 when the cementing plug means 88 and other internal components of the cementing tool 10 are drilled out of the housing 12 after the cementing job is completed. This non-rotatable feature is provided in the following manner.

The operating sleeve 32 has a first non-rotatable engagement means generally designated by the numeral 94 defined thereon adjacent the annular seat 68 at the upper end thereof. This non-rotatable engagement means 94 includes eight recessed areas 96 defined in a radially inner surface 98 of operating sleeve 32. The eight recessed areas 96 are angularly spaced from each other about a longitudinal central axis 100 of the tool 10 and the operating sleeve 32.

The non-rotatable engagement means 94 also includes eight upward facing, hat-shaped camming surface means 102, each of which separates adjacent ones of the recessed areas 96.

Referring now to FIG. 4, the bottom plug 90 of cement plug means 88 has a similar, but inverted, second non-rotatable engagement means 104 defined on the lower end thereof. The second non-rotatable engagement means 94 also includes recessed areas and camming surfaces defined on an external surface thereof which are complementary to and designed such that the downward pointing hat-shaped camming surfaces of the second non-rotatable engagement means 104 of bottom plug 90 are received in the recesses 96 of operating sleeve 32 with the upward facing, hat-shaped camming surfaces 102 of operating sleeve 32 being received in recesses of the second non-rotatable engagement means 104, so that the bottom plug 90 interlocks with the operating sleeve 32 to prevent rotation therebetween.

As will be appreciated by those skilled in the art, the bottom plug 90 is utilized to separate the bottom of a column of cement 106 from well fluids 108 located therebelow to prevent contamination of the cement prior to the time it is pumped through the cementing port 22.

Figure 5:
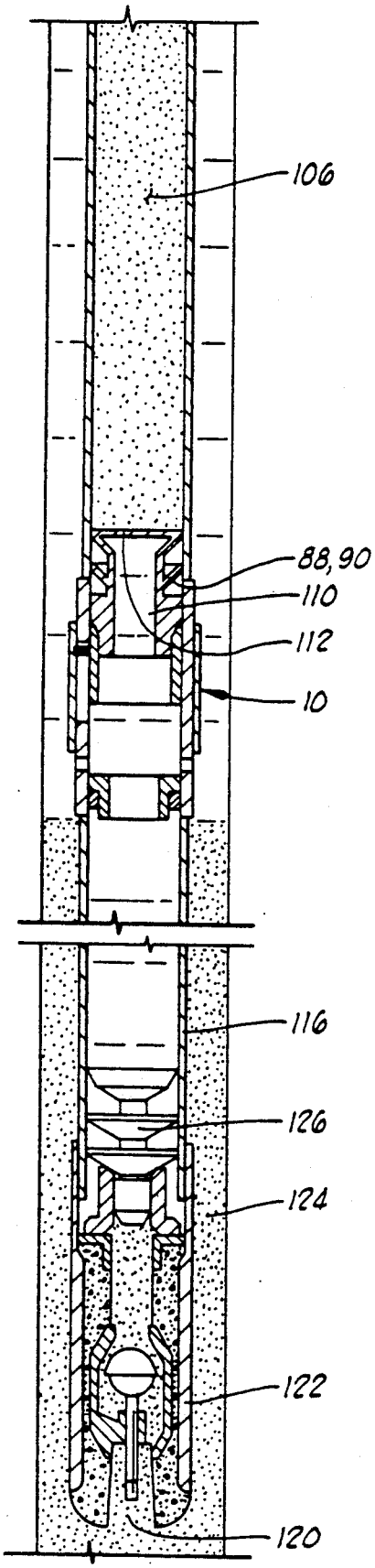

The bottom cementing plug 90, as best seen in the somewhat schematic sectioned view of FIG. 5 has a passage 110 therethrough which is initially closed by a rupture disc or diaphragm schematically illustrated as 112.

Figure 6:
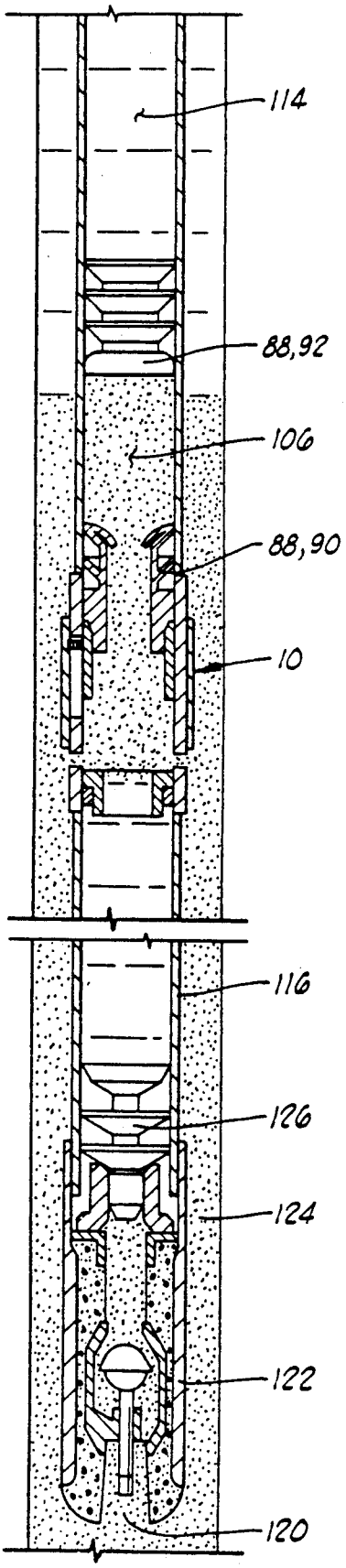

When the bottom plug 90 seats against seat 68 of operating sleeve 32 as schematically represented in FIG. 5, pressure on the cement column 106 is increased until the rupture disc 112 ruptures as represented in FIG. 6 thus permitting the cement to flow downward through the passage 110 of bottom plug 90 into the passage 18 of housing 12 of cementing tool 10 and out through cementing port 22.

As schematically illustrated in FIG. 6, the top plug 92 separates the upper extremity of the cement column 106 from a working fluid 114 thereabove. The top plug 92 is a closed plug having no passage therethrough, and when it engages bottom plug 90 as schematically illustrated in FIG. 7, the top plug 92 seals against bottom plug 90 closing the passage 110 therethrough. A non-rotatable engagement is provided between top plug 92 and bottom plug 90 to prevent top plug 92 from rotating relative to bottom plug 90 when the plugs are later drilled out. This non-rotatable engagement between the top and bottom plugs is like that shown in U.S. Pat. No. 4,858,687 to Watson et al. which is incorporated herein by reference.

After the top plug 92 has seated on the bottom plug 90 as schematically illustrated in FIG. 7, further fluid pressure can be applied to the working fluid 114 thereabove to shear the shear pin 70 holding the operating sleeve 32 in place relative to housing 12, thus allowing the operating sleeve 32 and closure sleeve 30 to move downward to the closed position of closure sleeve 30.

The shear pins 70 must be designed such that they can safely withstand the downward force applied thereto when pressure is applied to rupture the rupture disc 112 of bottom plug 90, and the shear pins 70 must also be designed so that they will shear and release the operating sleeve 32 at a predetermined pressure after the top plug 92 seats against bottom plug 90.

In the embodiment illustrated in FIG. 1, one of the shear pins 70 is located below each of the hat-shaped camming surfaces 102. The shear pins 70 may be collectively referred to as a releasable retaining means 70 for initially retaining the operating sleeve 32 in place relative to housing 12 with the cementing port 22 open as the rupture disc 112 of bottom cementing plug 90 is ruptured to open the passage 110 through the bottom cementing plug 90.

It is also noted that the apparatus 10 could be used with only a top cementing plug similar to plug 90 and having a non-rotatable engagement means similar to 104 defined thereon.

METHODS OF OPERATION UTILIZING THE APPARATUS OF FIG. 1

Turning now to FIGS. 3–8, the major steps of a multi-stage well cementing job utilizing the cementing tool 10 are schematically illustrated.

A well casing string 116 is located within a well bore 118.

The cementing tool 10 is placed in the casing string 116 before it is run into the well bore 118. It may be inserted between standard threaded connections of the casing at the desired locations of various cementing stages. A number of cementing stages are possible as long as each cementing tool 10 in the casing string 116 has a smaller inner diameter than the cementing tool immediately above it.

After the casing string 116 is in place within the well bore 118, the first or lowermost stage of cementing may be accomplished through a bottom opening 120 in a float shoe 122 arranged at the lower end of the casing string 116. The cement flows downward through casing 116 out the opening 120 and up into a well annulus 124 defined between the casing string 116 and well bore 118. A wiper plug 126 is inserted behind the first stage of cement slurry and displacing fluid of approximately the same specific gravity as the cement slurry is pumped behind the wiper plug 126 to displace the cement from the casing string 116.

As seen in FIG. 4, the wiper plug 126 will seat in the float shoe 122 thus stopping flow of the first stage of cement 128 up into the annulus 124. The first stage 128 of cement will extend to some point below the cementing port 122 of the cementing tool 10.

With the wiper plug 126 sealing the lower end of the casing string 116, pressure within the casing string 116 can be increased and will act against the differential area defined on opening sleeve 49 until the shear pins 62 are sheared and opening sleeve 49 of cementing tool 10 moves downward thus uncovering and opening the cementing port 22 as schematically illustrated in FIG. 4. Then cement 106 for the second stage cementing can be pumped down the casing 116 with the displacing fluids located therebelow being circulated through the cementing port 122 and back up the annulus 124. As previously indicated, a bottom cementing plug 90 is run below the cement 106 and a top plug 92 is run at the upper extremity of the cement 106.

The bottom plug 90 will seat against operating sleeve 32 as illustrated in FIG. 5. Further pressure applied to the cement column 106 will rupture the rupture disc 112 of bottom cementing plug 90 as illustrated in FIG. 6, and the second stage cement then flows out of cementing port 122 and upward through the annulus 124.

When the top plug 92 seats against bottom plug 90 closing the same, as shown in FIG. 7, the second stage of cementing represented by annular cement column 130 is terminated.

Figure 8:
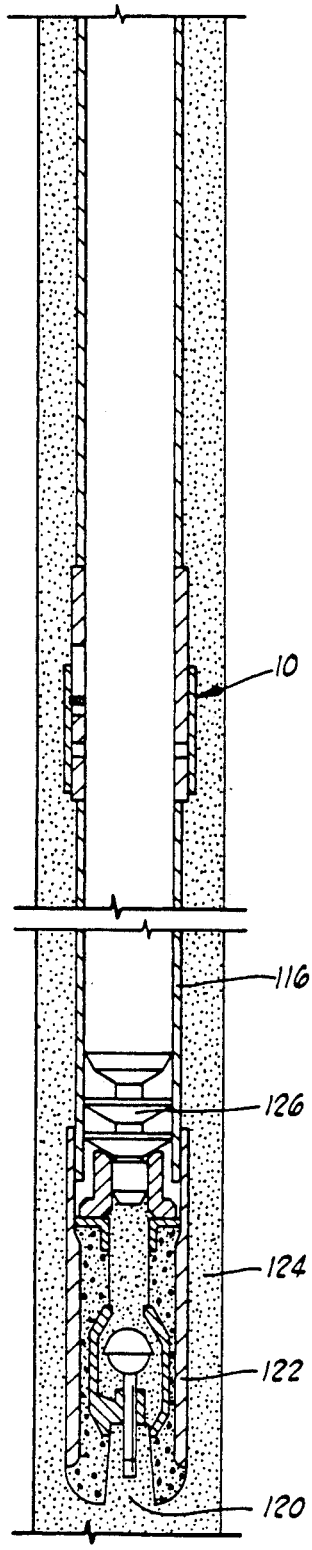

Subsequently, the cementing plugs 90 and 92, and the operating sleeve 32 and opening sleeve 49 and anchor ring 54 can all be drilled out of the casing 12 leaving a smooth bore through the cementing tool 10 as schematically illustrated in FIG. 8. The components to be drilled out of housing 12 including the operating sleeve 32, opening sleeve 49 and anchor ring 54 are all made from easily drillable materials such as aluminum. The cementing plugs 90 and 92 are also made of aluminum and rubber components which are easily drilled. Since all of these components are non-rotatably locked to each other and to the housing 12, the drilling of the same out of the housing 12 is further aided.

ALTERNATIVE EMBODIMENT OF FIG. 2

Figure 2:
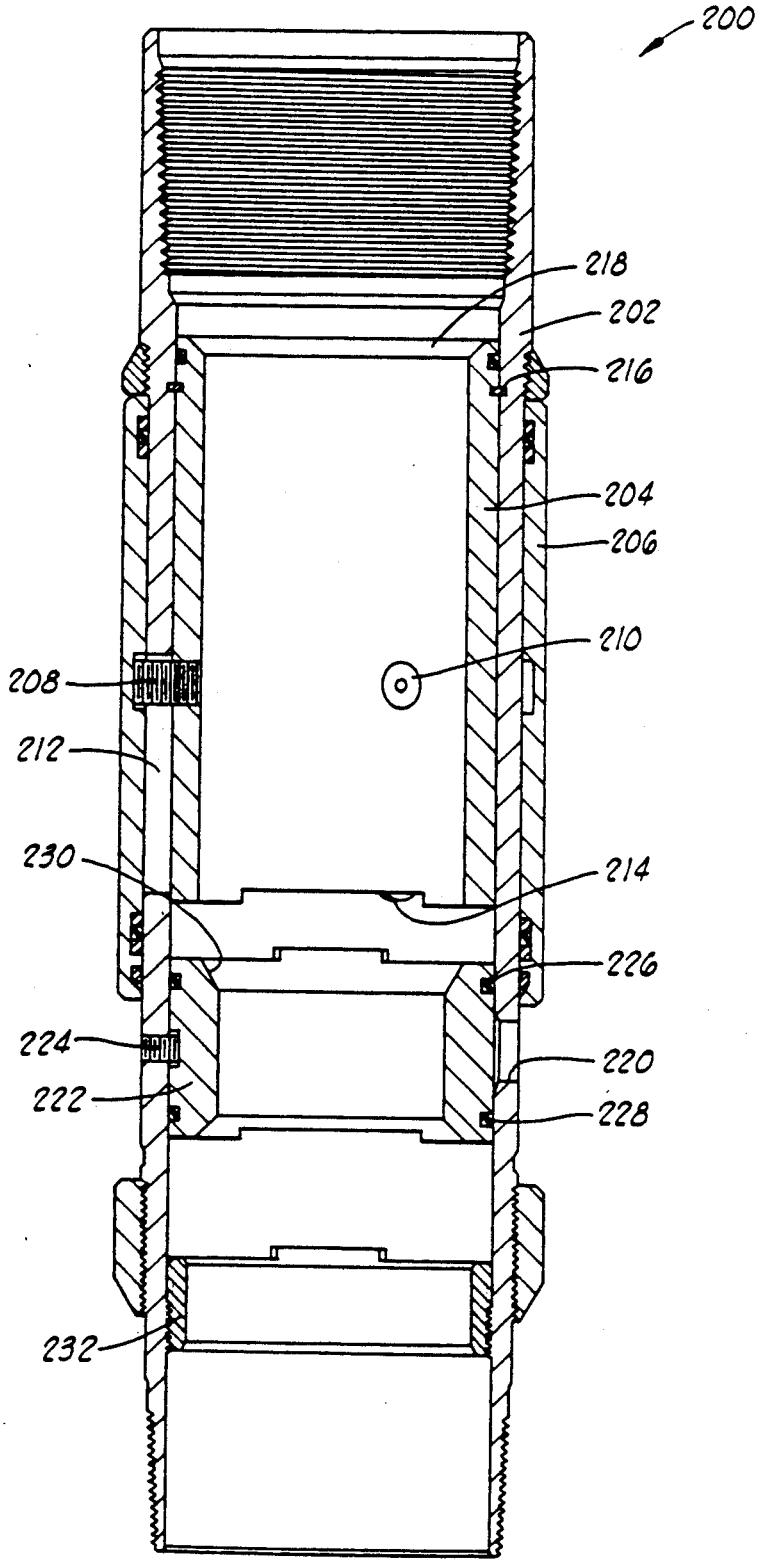
FIG. 2 is an elevation view sectioned view of an alternative embodiment of the invention utilizing a plug actuated lower internal opening sleeve.
Figure 3:
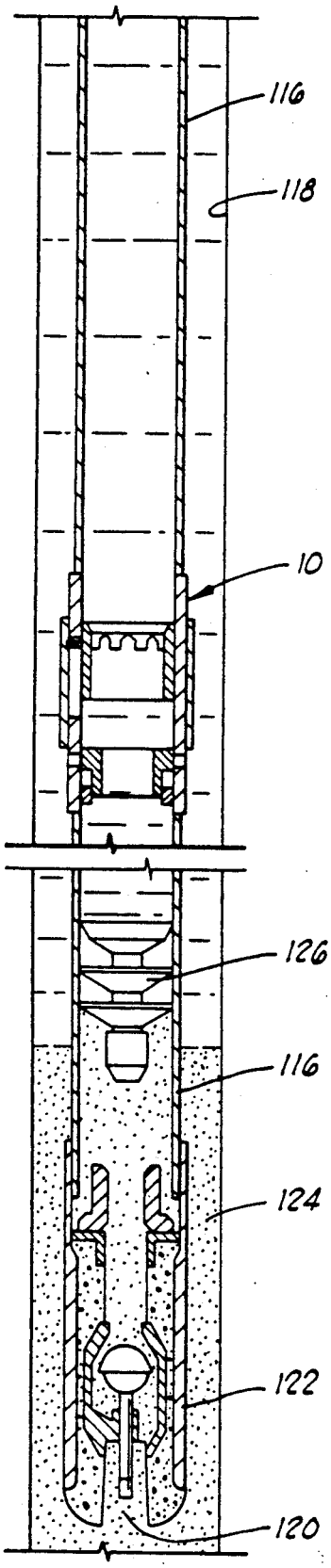
FIGS. 3–8 comprise a sequential series of views illustrating the use of the cementing tool of FIG. 1 to stage cement a well.

FIG. 2 illustrates an alternative embodiment of the cementing tool of the present invention which is shown and generally designated by the numeral 200. The cementing tool 200 differs primarily in that its opening sleeve is not hydraulically actuated but instead is designed to be actuated by engagement of a pump-down plug or free-all plug which seals the opening through the opening sleeve.

The cementing tool 200 includes a housing 202. An operating sleeve 204 is received therein. A closure sleeve 206 is received about the housing 202. A series of pins such as 208 and 210 extend through slots 212 and 214 to fixedly connect the operating sleeve 204 and closure sleeve 206. A shear ring 216 initially holds the operating sleeve 204 in place relative to housing 202. An annular seat 218 is defined upon the upper end of operating sleeve 204 for engagement with a cementing plug.

A cementing port 220 is disposed through the housing 202.

An opening sleeve 222 is located within the housing 202 and is initially held in place relative thereto by shear pins 224.

Upper and lower sliding O-ring seals 226 and 228 are carried by opening sleeve 222. The seals 226 and 228 are above and below, respectively, the cementing port 220 when the opening sleeve 222 is in its initial closed position as shown in FIG. 2.

The opening sleeve 222 has an annular seat 230 defined on its upper end which is constructed for engagement with a pump-down plug (not shown). When the pump-down plug engages seat 230 fluid pressure applied thereto acts downward to shear the shear pins 224 so that the plug and opening sleeve 222 can move downward until the opening sleeve 222 abuts an anchor ring 232. The upper O-ring seal 226 is then located below cementing port 220 so that a second stage of cement can be pumped out the cementing port 220 in a manner similar to that previously described with regard to the embodiment of FIG. 1.

Thus it is seen that the apparatus and methods of the present invention readily achieve the ends and advantages mentioned as well as those inherent therein. While certain preferred embodiments of the invention have been illustrated and described for purposes of the present disclosure, numerous changes may be made by those skilled in the art, which changes are encompassed within the scope and spirit of the present invention as defined by the appended claims.

What is claimed is:

1. A cementing tool apparatus, comprising:

a tubular housing having an inner passage defined longitudinally therethrough and having a radially outer surface, said housing also having a cementing port and a longitudinal slot both disposed through a wall thereof;

an outer closure sleeve slidably received about said outer surface of said housing and movable relative to said housing between an open position wherein said cementing port is uncovered by said closure sleeve and a closed position wherein said cementing port is closed by said closure sleeve;

an inner operating sleeve slidably received in said housing and slidable between first and second positions relative to said housing; and mechanical interlocking means, extending through said slot and operably associated with both said operating sleeve and said closure sleeve, for mechanically transferring a closing force from said operating sleeve to said closure sleeve and thereby moving said closure sleeve to its closed position as said operating sleeve moves from its first position to its second position.

2. The apparatus of claim 1, wherein:

said mechanical interlocking means is further characterized as a means for interlocking said operating sleeve and said closure sleeve together for common longitudinal movement relative to said housing throughout the entire movement of said operating sleeve from its said first position to its said second position, without any lost longitudinal motion of said operating sleeve relative to said closure sleeve.

3. The apparatus of claim 2, wherein:

said mechanical interlocking means includes at least one pin extending through said slot of said housing and fixedly connected to both said operating sleeve and said closure sleeve.

4. The apparatus of claim 1, wherein:

said closure sleeve is longitudinally hydraulically balanced.

5. The apparatus of claim 4, wherein:

said closure sleeve is always in fluid pressure communication with said inner passage of said housing.

6. The apparatus of claim 1, wherein:

said closure sleeve is always in fluid pressure communication with said inner passage of said housing.

7. The apparatus of claim 1, further comprising:

an inner opening sleeve slidably received in said inner passage of said housing below said operating sleeve, and slidable between a closed position wherein said cementing port is closed by said opening sleeve and an open position wherein said cementing port is uncovered by said opening sleeve; and wherein said closure sleeve is in fluid pressure communication with said inner passage of said housing when said operating sleeve is in its said first position and said opening sleeve is simultaneously in its said closed position.

8. The apparatus of claim 7, wherein:

said closure sleeve is longitudinally hydraulically balanced.

9. The apparatus of claim 1, further comprising:

two and only two sliding seals between said closure sleeve and said outer surface of said housing, one of said seals being located above said cementing port and the other being located below said cementing port when said closure sleeve is in its said closed position.

10. The apparatus of claim 1, wherein:

said closure sleeve is an external sleeve and has a radially outer surface which is exposed.

11. The apparatus of claim 1, further comprising:

mechanical locking means for locking said closure sleeve in its said closed position relative to said housing.

12. The apparatus of claim 1, wherein:

said mechanical interlocking means is further characterized as a means for preventing said operating sleeve from rotating relative to said housing as said operating sleeve is drilled out of said housing.

13. A method of operating a casing valve, said method comprising the steps of:

(a) providing in a well a casing string having the casing valve included therein, the casing valve having:

a housing with a port through a wall thereof;

an external valve sleeve slidably disposed about said housing; and an internal operating sleeve disposed in said housing;

(b) applying a moving force to said internal operating sleeve; and (c) mechanically transferring said moving force from said internal operating sleeve to said external valve sleeve without applying any unbalanced longitudinal hydraulic force directly to said valve sleeve, thereby moving said valve sleeve longitudinally from a first position thereof to a second position thereof relative to said housing.

14. The method of claim 13, wherein:

step (c) is further characterized in that said operating sleeve and said valve sleeve are fixedly connected together so that there is no lost longitudinal motion of said operating sleeve relative to said valve sleeve.

15. The method of claim 13, wherein:

step (a) is further characterized in that said valve sleeve is always in fluid pressure communication with an interior of said casing string.

16. The method of claim 13, wherein:

step (c) is further characterized in that in said first position of said valve sleeve said port is uncovered by said valve sleeve, and in said second position of said valve sleeve said port is closed by said valve sleeve.

17. The method of claim 13, further comprising:

locking said valve sleeve in its said second position.

18. The method of claim 13, further comprising:

drilling said operating sleeve out of said housing; and holding said operating sleeve so that it is prevented from rotating relative to said housing during said drilling.

* * * * *